US008061019B2

(12) United States Patent
Bisiach

(10) Patent No.: US 8,061,019 B2
(45) Date of Patent: Nov. 22, 2011

(54) HEAD FOR RIVETING MACHINE AND METHOD OF CONTROLLING SAME

(75) Inventor: Bruno Bisiach, Venaria (IT)

(73) Assignee: Bisiach & Carry S.p.A., Venaria Reale (TO) (IT)

( * ) Notice: Subject to any disclaimer, the term of this patent is extended or adjusted under 35 U.S.C. 154(b) by 808 days.

(21) Appl. No.: 12/101,670

(22) Filed: Apr. 11, 2008

(65) Prior Publication Data

US 2008/0250622 A1 Oct. 16, 2008

(30) Foreign Application Priority Data

Apr. 12, 2007 (IT) ..... TO07A0002

(51) Int. Cl.
*B23P 19/00* (2006.01)

(52) U.S. Cl. ..... 29/798

(58) Field of Classification Search ..... 29/715, 29/243.54, 524.1, 525, 525.01, 525.05, 525.06, 29/525.11, 520, 243.524, 243.529, 252, 243.53, 29/716, 798, 795, 796; 72/391.2, 391.4, 72/391.8; 279/57, 58

See application file for complete search history.

(56) References Cited

U.S. PATENT DOCUMENTS 5,208,959 A * 5/1993 Rosier et al. ..... 29/252
5,806,160 A * 9/1998 Frearson et al. ..... 29/243.523
6,766,575 B2 7/2004 Fulbright

FOREIGN PATENT DOCUMENTS

EP 0 512 806 A1 11/1992
GB 2 420 835 A 6/2006

OTHER PUBLICATIONS

European Search Report for EP 08 10 3457, dated Jul. 28, 2008.

* cited by examiner

*Primary Examiner* — John C Hong
(74) *Attorney, Agent, or Firm* — Sughrue Mion, PLLC

(57) ABSTRACT

A head for a riveting machine for applying shear rivets, the head comprising a plate and a body that have both a hole and are slidable relative to each other, and a sliding chuck equipped with jaws and arranged within a sliding chamber, defined inside said body, so as to engage a stem of the rivet, said chuck being capable of taking a first, engagement position and a second, disengagement position, wherein a control member controlling the sliding movement of the chuck is provided, said control member being in turn controlled by the plate sliding. The invention further concerns the method of controlling the head.

13 Claims, 3 Drawing Sheets

HEAD FOR RIVETING MACHINE AND METHOD OF CONTROLLING SAME

FIELD OF THE INVENTION

The present invention relates to a head for a riveting machine and a method of controlling same.

BACKGROUND OF THE INVENTION

A known process in mechanics is the cold permanent deformation of one end of a fastener, such as a nail, a rivet, a pin, a stud, an eyelet and so on, in order to form a head (or a counter-head, should the member be already provided with a head at the opposite end) at that end so as to obtain a fixed and non-removable connection of the pieces, e.g. section bars, sheets, rolled sections and so on, through which the fastener is arranged.

Said process, which can be either a manual or a mechanized process, is generally referred to as "setting" and, in case of mechanized processes, the tools employed will be referred to as "riveting machines".

In bodywork construction, especially but not only in aeronautical field, use of so-called shear rivets is known for fixedly connecting sheets. An example of such rivets is disclosed in GB 2 420 835.

FIGS. 1*a* and 1*b* show a rivet of the kind mentioned above applied to a pair of sheets L1, L2, before and after riveting, respectively.

This kind of rivet is generally denoted 11 and it includes a stem or shaft 13 having a head 15 and a threaded or grooved end 17*a*, and a collar 19 which is set on a threaded or grooved portion 17*b* of stem 13, by applying a relative axial traction between end 17*a* of stem 13 and collar 19. Said axial force causes moreover breakage of end 17*a* at a fracture zone, denoted by reference numeral 21, generally coincident with a corresponding annular groove.

Riveting machines designed for setting rivets of the above kind are also known. An example of such machines is disclosed in U.S. Pat. No. 6,766,575.

According to the prior art, the riveting process comprises the following steps:

- in a first step, rivet 11 is inserted into a hole previously formed through the pieces to be connected;
- collar 19 is then fitted onto rivet 11;
- rivet 11 is then inserted into the head of a riveting machine, which holds rivet stem 13 inside a chuck equipped with jaws;
- the front part of the machine head, generally consisting of a moving plate, is moved away from the head body, thereby causing the setting of collar 19 and the consequent breakage of end 17*a* of the stem;
- the front part of the machine head is then moved back against the body and the machine is ready for receiving a new rivet that, when entering the head, will cause ejection, through a rear opening provided therein, of end 17*a* or tail that has remained seized between the jaws.

One of the problems arising when designing a riveting machine for rivets of the above kind is related with the need of getting rid of the rivet end or tail, once the latter has been broken during the setting operation, so that the machine is ready for performing a new working cycle.

In currently employed machines, the tail is generally disposed of by exploiting the push of the tail of the subsequent rivet, which is introduced into the machine head thereby ejecting the tail of the previous rivet that has remained seized between the head jaws. Yet, this method is not suitable for use in all applications.

For instance, according to the prior art, the tail can be ejected only through the rear opening in the riveting machine head. Moreover, since ejection takes place by means of a push, jamming can frequently occur due for instance to blocking of the tail or the subsequent rivet, thereby causing machine stop.

More particularly, the known method is not suitable for applications in which the channel housing the rivet tail inside the riveting machine head is used also for the passage of a flow of cooling air.

Such an air flow is generally employed for cooling the sheet surfaces during drilling performed prior to rivet insertion.

Once drilling is completed, the rivet is inserted into the hole formed in the sheets, possibly upon application of a sealing material, and is then fixed by setting.

If, after the breakage of the tail, the latter remains seized inside the machine head until the arrival of the subsequent tail, the channel for the passage of the cooling air flow would be obstructed and the riveting machine head could not be used for cooling the surfaces when drilling the subsequent hole.

A further problem arising when using the prior art riveting machines is the impossibility of freeing the rivet from the head jaws once the rivet has been seized in order to perform the setting step.

Actually, it is clear that, if for any reason, for instance a fault in rivet manufacture or a wrong positioning of the riveting machine head, the operator realizes that the riveting operation cannot be properly performed, or that the tail did not break because of the above problems, an intervention on the riveting machine head will be necessary, in order to try to unlock the jaws for releasing the rivet.

This problem is particularly serious in case of automated, robot-controlled riveting machines. In such case indeed it would be necessary to manually operate in order to release the rivet from the head, often by disassembling part of the head, in positions which can hardly be reached by the hands of an operator and with working delays, incompatible with and automated or robotized process.

Thus, it is an object of the present invention to solve the above problems by providing a head for a riveting machine that allows a self-release of the rivet.

It is a second object of the invention to provide a head for a riveting machine that allows ejecting the rivet tail.

It is another object of the invention to provide a head for a riveting machine that allows clearing the channel inside the machine head after setting, thereby making said channel available for the passage of a cooling air flow.

It is a further object of the invention to provide a head for a riveting machine that, besides solving the above problem, can be constructed by simple and cheap modifications of the existing heads.

It is yet a further object of the invention to provide a method of operating a head for a riveting machine, which method allows solving the problems mentioned above and can be applied in existing heads, with a limited number of changes

SUMMARY OF THE INVENTION

The above and other objects are achieved by means of the head for a riveting machine and the relevant control method as claimed in the appended claims.

Advantageously, according to the invention, the rivet tail that has remained seized within the chuck after breakage is released from the engagement with the chuck jaws and can be ejected from the head either by gravity or by means of a flow of compressed air.

Moreover, since the member controlling the disengagement of the chuck from the tail is in turn controlled by the movement of the plate, a head according to the invention can be obtained by simple and cheap modifications to heads of already existing machines, made either during the design phase or on the head already constructed.

Another advantage of the invention is that the method of head control can be applied in simple manner to already existing heads, without need of modifying the control cycle of the moving parts of the head.

A further advantage of the invention is the possibility of freeing a rivet that has remained seized in the head jaws, by automatically operating and by substantially exploiting the same movements of the head parts as intended for the setting operation, and, above all, without need for human interventions on the head of the riveting machine

BRIEF DESCRIPTION OF THE DRAWINGS

An embodiment of the invention, given by way of example, will be described hereinafter with reference the accompanying drawings, in which.

DETAILED DESCRIPTION OF THE PREFERRED EMBODIMENT

Figure 1A:
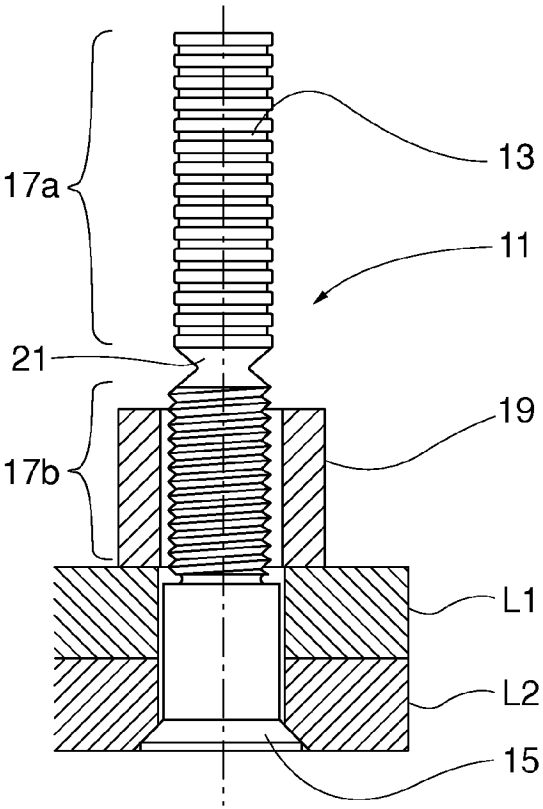
Fig. 1a Prior Art
FIGS. 1*a* and 1*b* show a rivet applied to a pair of sheets, before and after setting, respectively, as prior art.
Figure 1B:
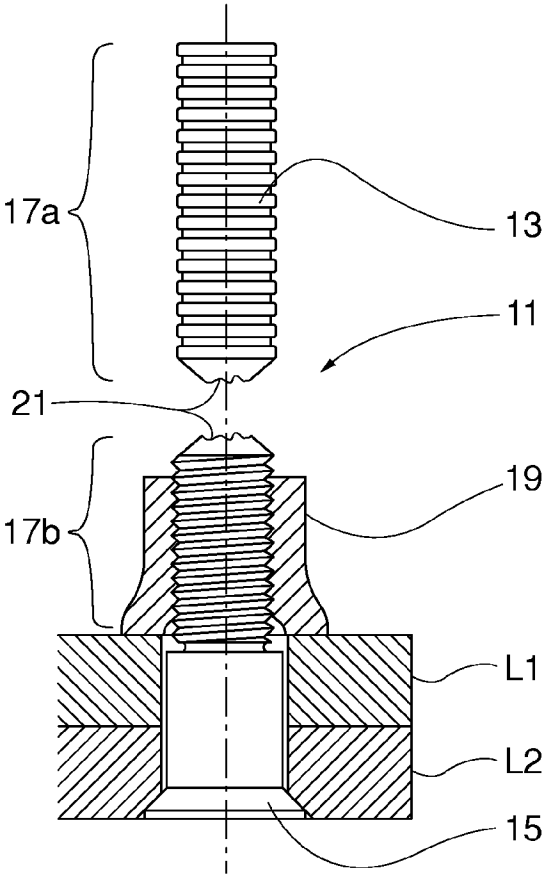
Fig. 1b Prior Art
Figure 2A:
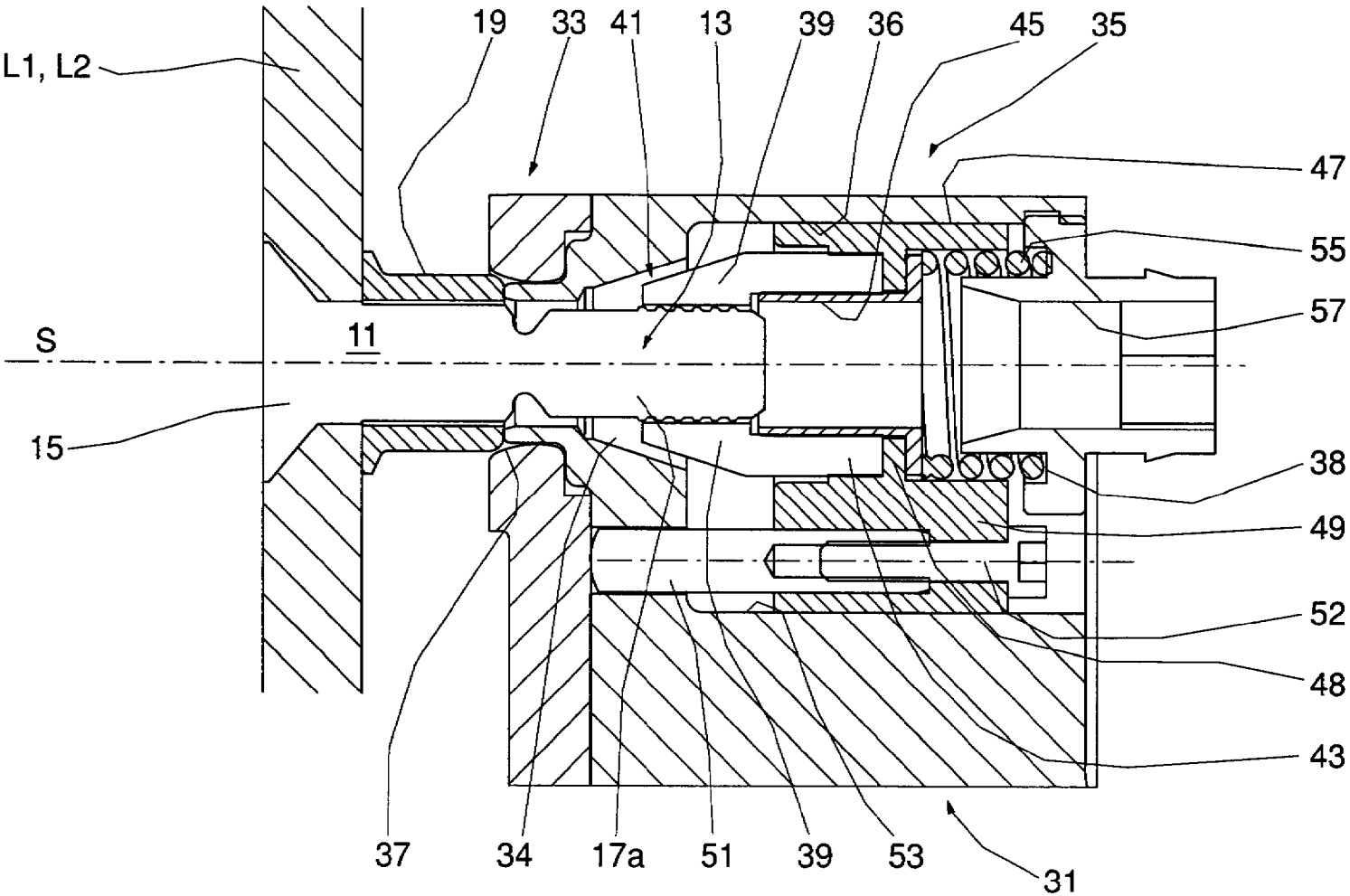
FIG. 2*a* shows the head according to the invention, in rivet engagement configuration.
Figure 2B:
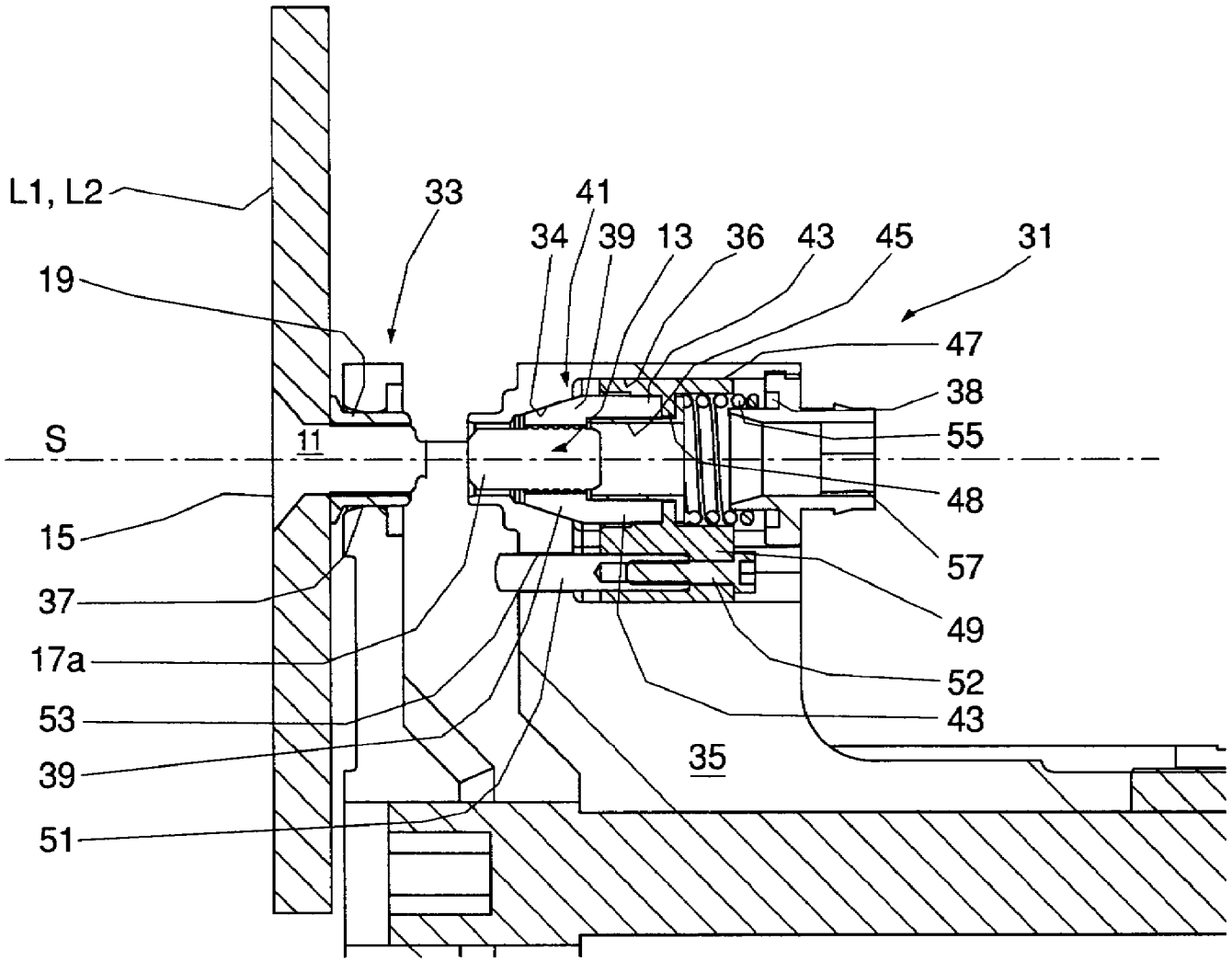
FIG. 2*b* shows the head according to the invention, in the configuration taken after the breakage has occurred.

Referring to FIGS. 2*a* and 2*b*, there is shown a head 31 of a riveting machine according to the invention, comprising a front part or plate 33 and a rear part or body 35. Thanks to means such as a hydraulic slide, not shown since they are known to the skilled in the art, said parts can slide relative to each other along a direction parallel to axis S of hole 37 formed in plate 33 and receiving stem 13 of rivet 11 and the associated ring 19, said axis being substantially coincident with the axis of stem 13 of said rivet 11 when the latter in inserted into said hole 37.

Body 35 has an axial hole which is formed along an axis substantially coincident with axis S of hole 37 formed in plate 33, and which receives the assembly engaging stem 13 of rivet 11 when the latter is seized in body 35.

A substantially cylindrical sliding chamber 36 is defined inside body 35 and houses:

- a sliding engagement assembly comprising a chuck 41 having a set of radial segments or jaws 39 arranged to engage threaded or grooved end 17*a* of stem 13 of rivet 11;
- a flexible sleeve 43, made of rubber or another material, which has secured thereto, preferably by curing, segments or jaws 39 of chuck 41;
- a bush 45, preferably made of metal, onto which rubber sleeve 43 is fitted;
- a ring nut 47, preferably made of metal, which surrounds rubber sleeve 43, is held between sleeve 43 and bush 45 by means of an internal annular projection 48 and is equipped with a radial support 49 that has fastened thereto, by means of a screw 52, a control member, the aim of which will be described further on; said control member consists of a pin 51 slidable within a side channel 53, parallel to sliding chamber 36 and having such an extension that it opens at the surface of body 35 towards plate 33 so as to let said pin come out from body 35;
- a resilient element 55, consisting for instance of a coil spring, located between the rear base of bush 45 and the bottom of sliding chamber 36, where an annular groove 38 receiving the base of said spring is formed.

Chuck 41 is slidable within chamber 36 so as to take an advanced position, in which it is contact with abutment 34 formed in correspondence with the front portion of chamber 36, and a retracted position, in which chuck 41 is spaced apart from said abutment.

The advanced position is taken by chuck 41 when head 31 is in idle condition, that is before the head receives stem 13 of rivet 11 or, as shown in FIG. 2*b*, after end 17*a* has broken thereby remaining seized within chuck 41.

The retracted position is taken instead by chuck 41 when head 31 is ready to perform setting, that is after stem 13 of rivet 11 has become engaged in chuck 41 by overcoming the force of resilient member 55 and the head is awaiting the command causing, through known means, the forward sliding of plate 33, whereby setting is performed.

The above description makes it clear that, in the absence of control member 51 controlling the backward movement of chuck inside chamber 36 due to the thrust of plate 33 during its return movement towards body 35, chuck 41 would remain in its advanced position after the rivet stem breakage, thereby making ejection of rivet end 17*a*, seized between jaws 39, difficult.

On the contrary, thanks to the control member, which is in turn controlled by plate 33 during the backward movement the plate performs, through known means, in order to go back against body 35 and to prepare itself to receive a new rivet, chuck 41 moves backwards inside sliding chamber 36 and away from abutment 34. In this manner, jaws 39, thanks to the deformation of sleeve 43 supporting them, can move radially away from rivet end 17*a*, which can subsequently be ejected either by gravity or, preferably, by means of a flow of compressed air coming for instance from rear opening 57 of chamber 36, formed in body 35.

According to the invention, the method of controlling the head comprises the steps of:

- engaging stem 13 of rivet 11 into chuck 41 by overcoming the resistance of resilient member or coil spring 55;
- controlling the sliding of plate 33 relative to body 35 in a first direction such that the plate and the body move away from each other, thereby causing the setting of collar 19 onto rivet 11 and the subsequent breakage of end 17*a* of stem 13 of rivet 11;
- controlling the sliding of plate 33 relative to body 35 in a second direction opposite to the first one, thereby causing displacement of control member 51 and, consequently, disengagement of jaws 39 of chuck 41 from end 17*a* of rivet 11;
- possibly performing a pushing action, e.g. by means of a flow of compressed air, through rear opening 57 of head 31 or through front hole 37 of the head, thereby causing ejection of end 17*a* through front hole 37 of the head 31 or through rear opening 57, respectively.

What I claim is:

1. A head for a riveting machine for applying shear rivets, the head comprising:

- a front part and a rear part comprising a plate and a body, respectively; said plate having an axial hole for receiving a stem of a rivet and said body having an axial hole formed along the same or substantially same axis of the hole formed in the plate; said plate and body slidable relative to each other along a direction parallel to said axis of the hole formed in the plate;

a sliding engagement assembly arranged within a sliding chamber, defined inside said body, so as to engage the stem of a shear rivet, said engagement assembly being capable of taking a first, advanced position and a second, retracted position inside said chamber;

a chuck having a set of radial segments or jaws arranged to engage a threaded or grooved end of the stem of the rivet;

a flexible sleeve which has secured thereto the segments or jaws of said chuck;

a control member controlling the backward movement of said engagement assembly due to a thrust of said plate during a return movement of said plate towards said body, said control member comprising a pin slidable within a side channel, parallel to said sliding chamber and having an extension that opens at the surface of said body towards said plate so as to let said pin come out from said body;

a bushing onto which said flexible sleeve is fitted; and a ring nut that surrounds said flexible sleeve and is held between said sleeve and said bushing by an internal annular projection; said control member fastened to a radial support provided by said ring nut.

2. The head as claimed in claim 1, wherein said control member is in turn controlled by the sliding of the plate.

3. The head as claimed in claim 1, wherein said pin is secured to the radial support through a screw.

4. The head as claimed in claim 1, wherein said sleeve made of rubber.

5. The head as claimed in claim 1, wherein said sleeve is made of rubber and said jaws are secured to the sleeve by curing.

6. The head as claimed in claim 5, wherein said bushing is made of metal.

7. The head as claimed in claim 1, wherein the sliding of the engagement assembly inside the sliding chamber is opposed by a resilient member.

8. The head as claimed in claim 7, wherein the resilient member is a coil spring.

9. The head as claimed in claim 8, wherein the axis of the coil spring is coaxial with the assembly formed by the bushing, the sleeve and the ring nut.

10. The head as claimed in claim 1, wherein the ring nut is a distinct and separate part from the bushing and the ring nut surrounds at least portion of sleeve along an axial length of the sleeve and is positioned radially outward of the sleeve.

11. The head as claimed in claim 1, wherein a portion of the ring nut is axially held between the bushing and the sleeve.

12. A riveting machine, comprising a head in accordance with claim 1.

13. A head for a riveting machine for applying shear rivets, the head comprising:

a plate at a front portion of the head;

a body behind the plate;

the plate comprising a hole for receiving a stem of a rivet;

the body having a hole formed substantially coaxially with an axis of the hole formed in the plate;

the plate and body slidable relative to each other along a direction parallel to an axis of the hole formed in the plate;

a sliding engagement assembly arranged within a sliding chamber inside the body, so as to engage the stem of a shear rivet, the engagement assembly configured to move to an advanced position and then to a retracted position inside the chamber;

the sliding engagement assembly comprising a chuck comprising radial segments configured to engage a threaded or grooved end of the stem of the rivet;

a flexible sleeve secured to the segments of the chuck;

a control member backwardly moving the engagement assembly by transmitting a thrust of the plate during a return movement of the plate towards the body, the control member comprising a pin slidable within a side channel parallel to the axis of the hole formed in the plate, the side channel opening at a surface of the body facing the plate so as to let the pin protrude from the body;

a bushing onto which the flexible sleeve is fitted;

a ring nut that surrounds the flexible sleeve along an axial length the flexible sleeve, the ring nut comprising an internal annular projection held axially between the flexible sleeve and the bushing; and the control member is fastened to a support on the ring nut.

* * * * *

UNITED STATES PATENT AND TRADEMARK OFFICE

CERTIFICATE OF CORRECTION

PATENT NO. : 8,061,019 B2
APPLICATION NO. : 12/101670
DATED : November 22, 2011
INVENTOR(S) : Bruno Bisiach It is certified that error appears in the above-identified patent and that said Letters Patent is hereby corrected as shown below:

Title Page, Item (73) Assignees: "Bisiach & Carry S.p.A., Venaria Reale (TO) (IT)" should read --Bisiach & Carru' S.p.A., Venaria Reale (TO) (IT)--

Signed and Sealed this
Thirteenth Day of March, 2012

David J. Kappos

David J. Kappos
*Director of the United States Patent and Trademark Office*